US005979154A

United States Patent [19]

Dür

[11] Patent Number: 5,979,154

[45] Date of Patent: Nov. 9, 1999

[54] MULTI-TWISTING SPINDLE WITH ROTATING BALLOON LIMITER

[75] Inventor: Hansjörg Dür, Schwarzach, Austria

[73] Assignee: Hamel AG, Arbon, Switzerland

[21] Appl. No.: 09/100,213

[22] Filed: Jun. 19, 1998

[30] Foreign Application Priority Data

Jun. 21, 1997 [DE] Germany ..... 197 26 450

[51] Int. Cl.[6] ..... D01H 1/10

[52] U.S. Cl. ..... 57/58.83; 57/58.49; 57/58.7; 57/58.84

[58] Field of Search ..... 57/58.49, 58.7, 57/58.72, 58.83, 58.84, 58.86

[56] References Cited

U.S. PATENT DOCUMENTS

| | | | |
|---|---|---|---|
| 3,754,389 | 8/1973 | Nakahara et al. | 57/58.86 |
| 4,287,712 | 9/1981 | Franzen | 57/58.86 |
| 5,515,671 | 5/1996 | Dur | 57/57.83 |

FOREIGN PATENT DOCUMENTS

| | | |
|---|---|---|
| 1510834 | 3/1970 | Germany . |
| 1510836 | 3/1970 | Germany . |
| 2939645 | 4/1981 | Germany . |
| 4307685 | 11/1994 | Germany . |

*Primary Examiner*—William Stryjewski
*Attorney, Agent, or Firm*—Robert W. Becker & Associates

[57] ABSTRACT

A multi-twisting spindle has a hollow spindle axle defining the axial direction of the twisting spindle. A bobbin support including a support bottom and a protective pot is rotatably connected to the hollow spindle axle. A rotor disk is fixedly connected to the hollow spindle axle. A balloon limiter is connected to and rotates with the rotor disk. The protective pot is positioned radially inwardly in the balloon limiter. A gap is formed between the balloon limiter and the protective pot. The protective pot is driven in a rotational direction opposite to the rotational direction of the balloon limiter. The rotor disk has a yarn guide channel connected to the hollow spindle axle and extending radially outwardly away from the hollow spindle axle. A deflection channel is connected to the yarn guide channel and has an outlet that opens into the gap. A yarn catch ring is arranged axially spaced below the support bottom in a radially outer area of the support bottom. The yarn catch ring rotates together with the balloon limiter. The yarn catch ring has an outer diameter that is smaller than the outer diameter of the protective pot.

10 Claims, 3 Drawing Sheets

MULTI-TWISTING SPINDLE WITH ROTATING BALLOON LIMITER

BACKGROUND OF THE INVENTION

Multi-twisting spindles are provided with a yarn storage disc that serves to receive, between the radial exit of the yarn from the spindle and the yarn balloon, a yarn reserve that ensures a uniform yard tension and thus a uniform twisted yarn. The yarn storage by a yarn storage disc can be referred to as an inertia-free yarn brake.

For a multi-twisting spindle for a three-fold twisting action, the balloon limiter rotating counter to the direction of rotation of the bobbin support or protective pot of the bobbin support is used as a storage zone. The storage at the inner mantle of the rotating balloon limiter can be imagined as a spacial curve of the yarn (slight spiral shape). The balloon yarn is retained due to the air friction in the gap between the protective pot that rotates counter to the direction of rotation of the spindle rotor and the balloon limiter, i.e. the yarn is slowed or braked.

According to German Patent 43 07 685, a yarn guide eye positioned at the upper edge of the balloon limiter is designed to prevent a possible winding of the balloon yarn about the protective pot rotating counter to the spindle rotor and the balloon limiter.

The spacial curve of the yarn begins at the outlet opening of the spindle rotor and ends either at the upper edge of the balloon limiter provided with a yarn guide eye through which the yarn is guided or, if such a yarn guide eye is not provided, directly at the extension of the spindle axle where a balloon yarn guide eye is provided.

When the spindle operator is not careful, it may happen that the balloon yarn is not precisely positioned between the outlet opening of the spindle rotator in the lower area of the balloon limiter and the yarn guide eye at the upper edge of the balloon limiter. This may result, especially during the initial startup of the spindle or the shut down of the spindle, in the balloon yarn winding itself about the oppositely rotating protective pot of the bobbin support. This results in a "rewinding" process since the yarn from the supply bobbin, substantially without being slowed down, can enter into the area of the yarn balloon. This winding process, depending on the individual (tear) strength of the yarn, can result in blockage of the spindle parts rotating in the opposite direction.

Such a blockage between the rotating spindle parts can result especially when parts of the wound yarn are guided from the cylindrical mantle of the protective pot in the downward direction and into the relatively narrow gap between the upper side of the spindle rotor and the lower bottom area of the bobbin support.

In two-for-one twisting spindles it is conventional to provide means for receiving wound yarn between the upper side of the spindle rotor and the bottom side of the protective pot bottom, for example, as shown in the drawings of German Patent 1 510 834 and 1 510 836 illustrated by the labyrinth embodiment between rotor andprotectivepotbottom. Furthermore, German Patent Application 29 39 645 deals with a measure for preventing introduction of wound yarn into the bearing area of a two-for-one twisting spindle.

Such measures at two-for-one twisting spindles, however, are not suitable for preventing blockage by winding of yarn for a three-for-one twisting spindle because in a two-for-one twisting spindle the initial situation is always a rotating machine part in relation to a stationary machine part, while for a three-for-one twisting spindle the wound yarn formation that could cause a blockage must be prevented between two parts rotating opposite to one another.

It is therefore an object of the present invention to provide for a multi-twisting spindle with balloon limiter rotating counter to the bobbin support a measure for preventing blockage between the rotating spindle parts resulting from yarn being introduced between the counter-rotating spindle parts by quickly interrupting the aforementioned damaging winding process.

SUMMARY OF THE INVENTION

A multi-twisting spindle according to the present invention is primarily characterized by:

A hollow spindle axle defining an axial direction of the twisting spindle;

A spindle support, comprising a support bottom and a protective pot, rotatably connected to the hollow spindle axle;

A rotor disk fixedly connected to the hollow spindle axle;

A balloon limiter connected to and rotating with the rotor disk;

The protective pot positioned radially inwardly in the balloon limiter, wherein a gap is formed between the balloon limiter and the protective pot;

The protective pot driven in a rotational direction opposite to the rotational direction of the balloon limiter;

The rotor disk having a yarn guide channel connected to the hollow spindle axle and extending radially outwardly away from the hollow spindle axle;

A deflection channel connected to the yarn guide channel and having an outlet that opens into the gap;

A yarn catch ring arranged axially spaced below the support bottom in a radially outer area of the support bottom;

The yarn catch ring rotating together with the balloon limiter;

The yarn catch ring having an outer diameter that is smaller than an outer diameter of the protective pot.

Advantageously, the yarn catch ring is connected to an upper side of the rotor disk and projects upwardly from the rotor disk;

The yarn catch ring and the rotor disk delimit a yarn catch groove at the upper side of the rotor disk.

The yarn catch ring has an outer surface having a radially inwardly and downwardly slanted under cut for forming the yarn catch groove.

The yarn catch ring in the area of the yarn catch groove has a surface for increasing yarn friction at the yarn catch ring.

The support bottom has an underside having an annular groove and the yarn catch ring projects into the annular groove.

The rotor disk and the yarn catch ring form a unitary part.

Advantageously, the rotor disk has an upper side with a receiving opening. The yarn catch ring is inserted into the receiving opening and the yarn catch ring consists of a material increasing yarn friction at the yarn catch ring.

The yarn catch ring is advantageously comprised of pins or ring segments inserted into the upper side of the rotor disk.

The yarn catch ring is comprised of an annular member and pins or ring segments attached to the annular member.

The protective pot has preferably a bottom edge positioned axially above the outlet of the deflection channel.

According to the present invention, the upper side of the rotor disk has a yarn catch ring provided thereat and projecting upwardly therefrom whereby its diameter is smaller than the outer diameter of the bobbin support, respectively, the bobbin support protective pot.

The wound yarn that glides in the downward direction from the outer mantle of the protective pot is received in the preferably grooved-shaped design of the yarn catch ring which substantially has the same effect as a labyrinth ring.

Pulling of the yarn from the supply bobbin can then occur only in the lower area of the balloon limiter along the yarn catch ring and further on the outer circumference of the protective pot. However, since the yarn outlet at the spindle rotor in the lower area of the balloon limiter and the yarn catch ring rotate together, only so many windings at the yarn catch ring can be produced as allowed by the yarn friction between the yarn and the yarn catch ring. In practice, it has been shown that already after two windings the yarn friction has reached values that even for yarns having greatest tear strength yarn breakage results. The torn-off wound piece of yarn on the yarn catch ring, since it comprises only two windings, can remain on the yarn catch ring and can be removed during a subsequent scheduled servicing of the spindle.

The formation of windings on the yarn catch ring can be further reduced by providing the yarn catch ring, especially in the area of the yarn catch groove, with a surface that increases yarn friction.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 though 4.

Figure 1:
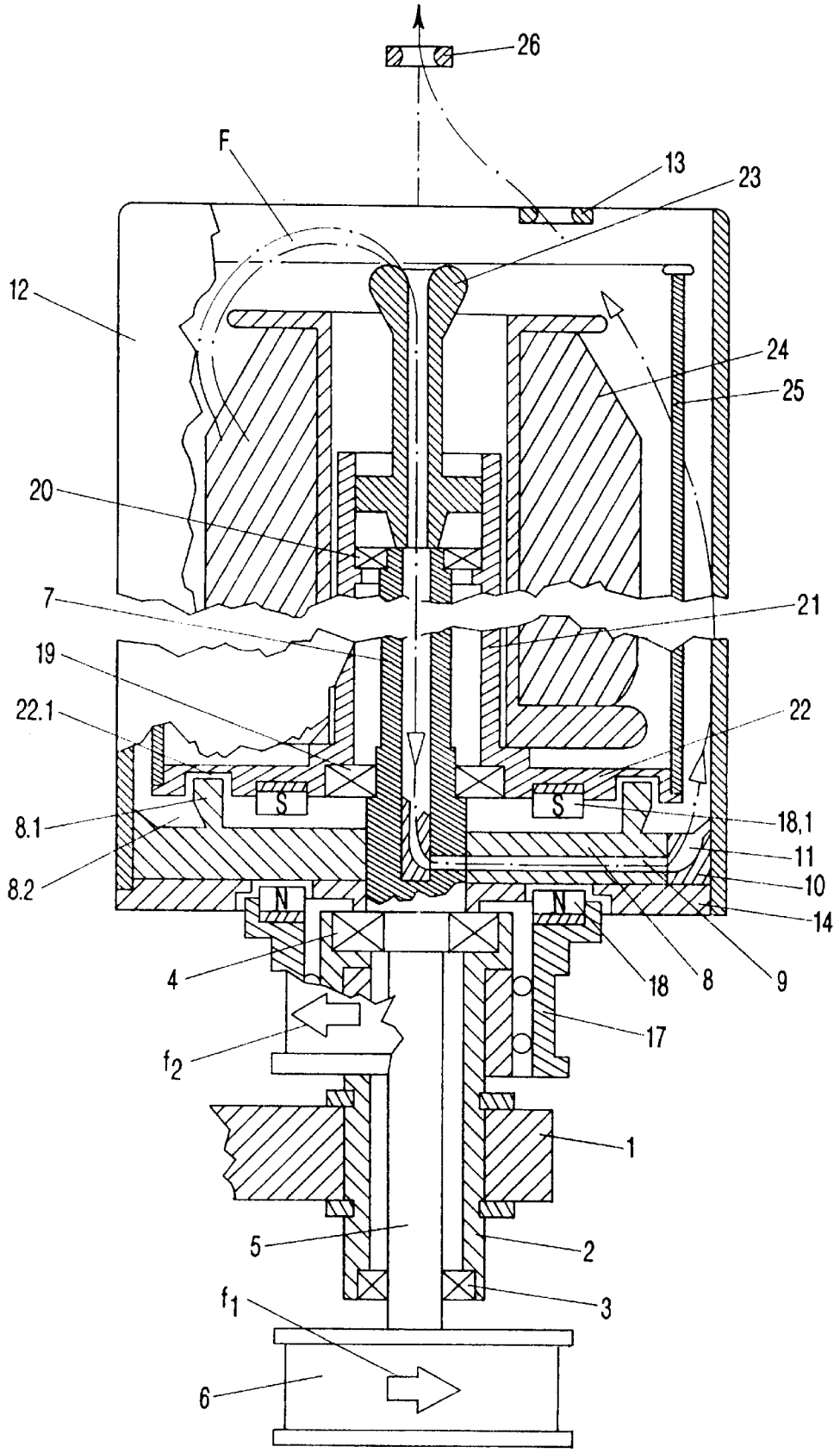
FIG. 1 shows an axial section of a multi-twisting spindle with three-fold twisting action in combination with a first embodiment of the yarn catch ring.

FIG. 1 shows as a representative part of a twisting machine a portion of a spindle bank 1 in which the spindle bearing sleeve 2 is stationarily supported. In the spindle bearing sleeve 2 a spindle shaft 5 is rotatably supported by bearings 3 and 4 and has connected to its lower end a rotatably driven spindle whorl 6 (direction of rotation f1). The upper end of the spindle shaft 5 is connected to a hollow spindle axle 7 having at its lower end a rotor disk 8 with a radially extending yarn guide channel 9. A yarn eye 10 is inserted into the rotor disk so as to communicate with the yarn guide channel 9. The yarn eye 10 comprises a axially upwardly extending deflection channel 11. A balloon limiter 12 extends upwardly from the rotor disk 8 which in its upper area, preferably at the upper edge of the balloon limiter, has a yarn guide eye 13 that is positioned at an angular spacing relative to the radial outlet of the yarn guide channel 9, respectively, the deflection channel 11. The lower edge of the balloon limiter 12 is closed off in the downward direction by an annular member 14.

A bobbin support whorl 17 is rotatably supported at the spindle bearing sleeve 2 and rotates counter to the direction of the spindle whorl 6 in the direction of arrow f2. Follower magnets 18 are inserted into the upper sleeve-shaped end of the bobbin support whorl 17 along a circular path. They project below the rotor disk 8 into an annular chamber.

A sleeve-shaped bobbin support hub 21 is rotatably supported by bearings 19 and 20 on the hollow spindle axle 7 and has at its lower end a bobbin support bottom 22 which supports at its outer circumference a protective pot 25. At the underside of the bobbin support bottom 22 counter magnets 18.1 are attached which are positioned opposite the follower magnets 18. With respect to the follower magnets 18 the counter magnets 18.1 are polarized such that when the bobbin support whorl 17 rotates, the bobbin support hub 21, the bobbin support bottom 22, and the protective pot 25, forming the bobbin support, rotate in the same rotational direction. A yarn introduction tube 23 is inserted into the upper end of the bobbin support hub 21 concentrically to the hollow spindle axle 7. A supply bobbin 24 is placed onto the bobbin support hub 21 such that it is supported by the bobbin support bottom 22 so that the supply bobbin 24 when the support 21, 22 rotates is also is rotated without slip.

When the spindle rotates, the yarn F is upwardly removed from the supply bobbin 24 and is guided through the yarn introduction tube 23 and the hollow spindle axle 7 first in the downward direction and then through the radially extending yarn guide channel 9 in the radially outward direction. It is then guided between the protective pot 25 and the balloon limiter 12 upwardly to a yam guide eye 26 positioned on an extension of the axis of the hollow spindle axle. From here, the yarn is then guided to a non-represented winding device. In order to achieve a yarn storage corresponding to the respective removal conditions, the yarn is guided through the yarn guide eye 13 which is positioned at a suitable angular position, preferably 20° to 120°, from the outlet of the radially extending yarn guide channel 9, respectively, deflection channel 11.

The invention resides in a yarn catch ring 8.1 positioned in the radially outermost zone of the bobbin support bottom 22 below and axially spaced therefrom. It projects from the upperside of the rotor disk 8 and rotates together with it and the balloon limiter 12. This yarn catch ring 8.1 is embodied as a unitary part of the rotor disk 8 and extends axially toward the underside of the bobbin support bottom 22. The outer diameter of this ring 8.1 is smaller than the outer diameter of the bobbin support bottom 22 and of the bobbin support protective pot 25. The ring 8.1 which, for formation of the labyrinth seal, preferably extends into an annular groove 22.1 provided at the underside of the support bottom 22 has, for formation of a yarn catch groove 8.2 at its outer circumference, an inwardly and downwardly oriented undercut. The yarn catch ring 8.1 is provided, especially in the area of the yarn catch groove 8.2, with a surface that increases yarn friction.

Figure 2:
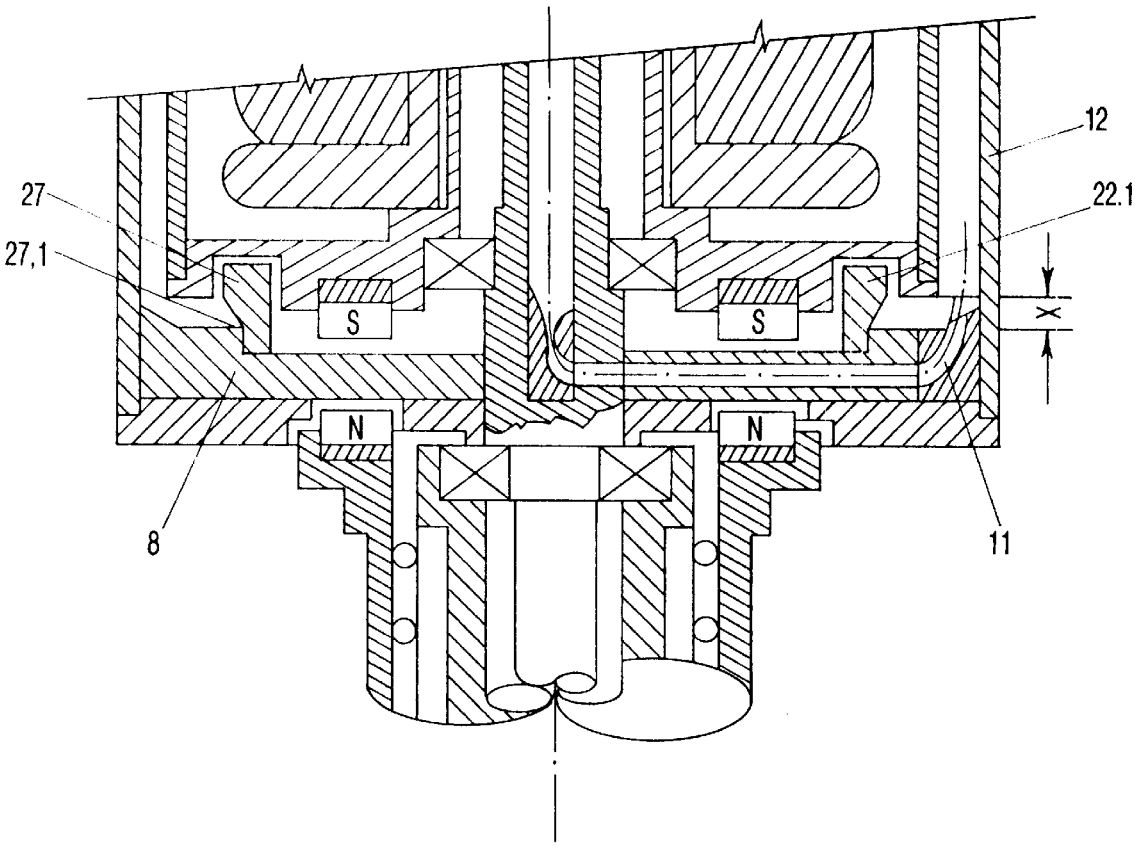
FIG. 2 shows an axial section of a second embodiment of a yarn catch ring.

The function of the inventively designed yarn catch ring 8.1 can be taken from the explanations provided above. The yarn catch ring 27 provided in FIG. 2 is a separate member and inserted into a receiving opening at the upper side of the rotor disk 8. It is comprised preferably of a material that increases yarn friction. The ring 27 is provided with an inwardly and downwardly oriented undercut which provides adjacent to the rotor disk 8 a yarn catch groove 27.1.

Figure 3:
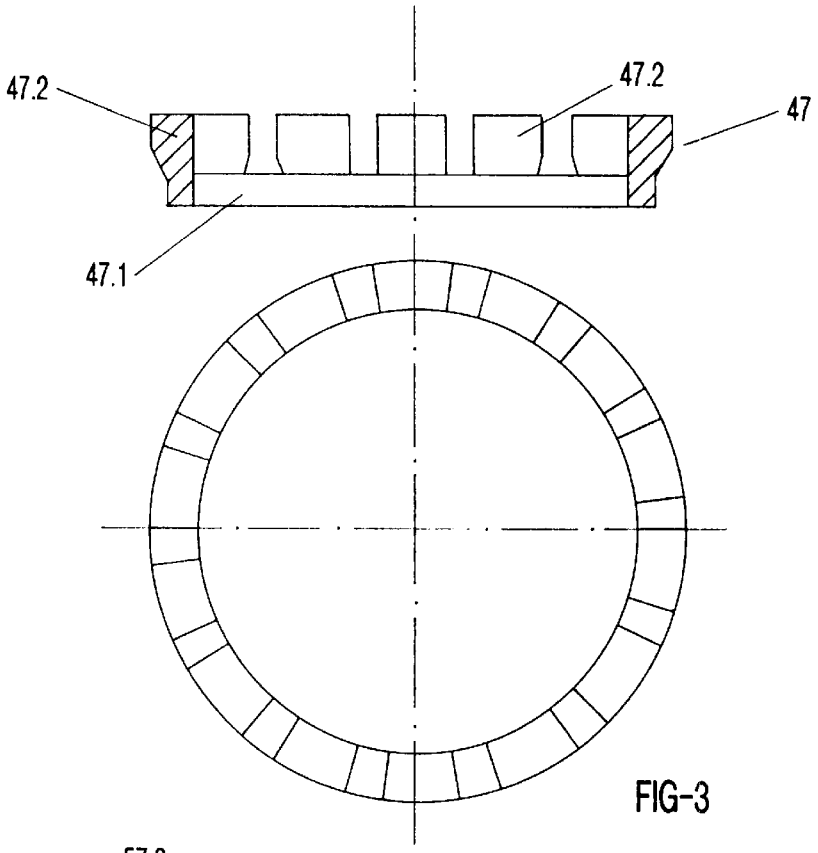
FIG. 3 shows in a plan view and in an axial view one embodiment of a segmented yarn catch ring.

FIG. 3 shows a yarn catch ring 47 introduced into a receiving opening of the rotor disk 8 and comprised of an annular member 47.1 with ring segments 47.2 connected thereto.

Figure 4:
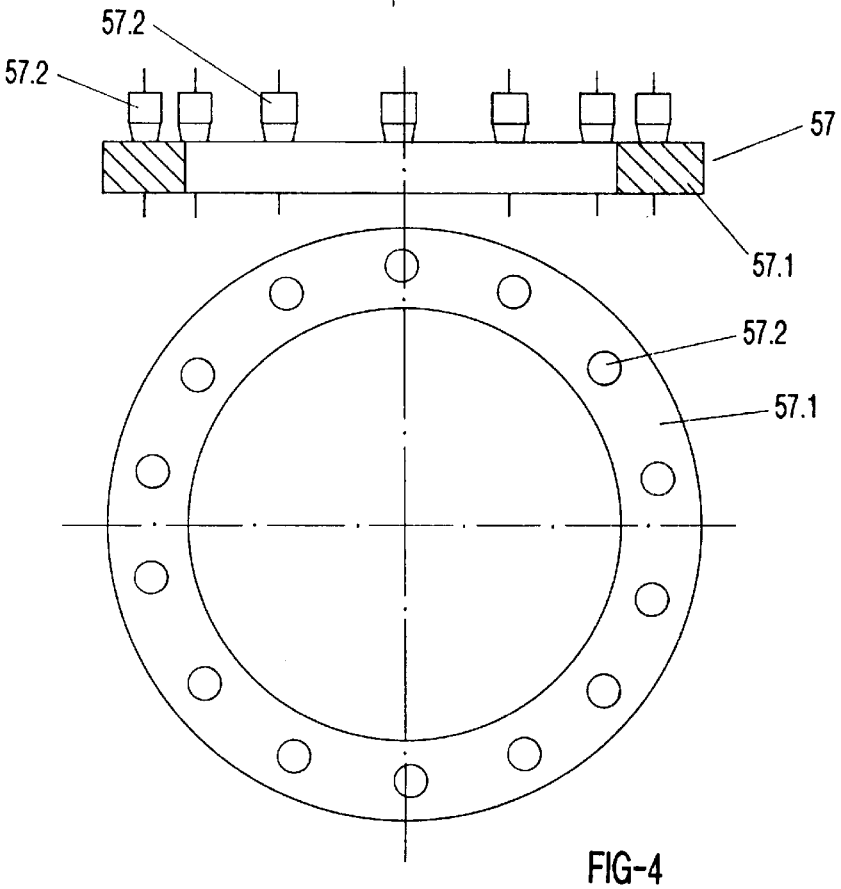
FIG. 4 shows a further embodiment of a segmented yarn catch ring in a plan view and in an axial view.

According to FIG. 4 the yarn catch ring 57 is comprised of an annular member 57.1 with pins 57.2 inserted therein. The advantage of these two embodiments is an improved air circulation that contributes to reducing soiling of the inner rotating spindle parts. Furthermore, wound yarn portions can be easily removed because of the intermediate spaces between the segments or pins.

Especially advantageous for an improved function of the yarn catch ring is a height difference X between the lower edge of the protective pot 25 and the outlet of the deflection channel 11. The lower edge of the protective pot should be in any case at a higher level than the outlet of the deflection channel 11 at the balloon limiter rotating with the bobbin support.

The present invention is, of course, in no way restricted to the specific disclosure of the specification and drawings, but also encompasses any modification within the scope of the appended claims.

What is claimed is:

1. A multi-twisting spindle comprising:

a hollow spindle axle defining an axial direction of said twisting spindle;

a bobbin support, comprising a support bottom and a protective pot, rotatably connected to said hollow spindle axle;

a rotor disk fixedly connected to said hollow spindle axle;

a balloon limiter connected to and rotating with said rotor disk;

said protective pot positioned radially inwardly in said balloon limiter, wherein a gap is formed between said balloon limiter and said protective pot;

said protective pot driven in a rotational direction opposite to a rotational direction of said balloon limiter;

said rotor disk having a yarn guide channel connected to said hollow spindle axle and extending radially outwardly away from said hollow spindle axle;

a deflection channel connected to said yarn guide channel and having an outlet that opens into said gap;

a yarn catch ring arranged axially spaced below said support bottom in a radially outer area of said support bottom;

said yarn catch ring rotating together with said balloon limiter; and said yarn catch ring having an outer diameter that is smaller than an outer diameter of said protective pot.

2. A twisting spindle according to claim 1, wherein:

said yarn catch ring is connected to an upper side of said rotor disk and projects upwardly from said rotor disk;

said yarn catch ring and said rotor disk delimit a yarn catch groove at said upper side of said rotor disk.

3. A twisting spindle according to claim 2, wherein said yarn catch ring has an outer surface having a radially inwardly and downwardly slanted undercut for forming said yarn catch groove.

4. A twisting spindle according to claim 2, wherein said yarn catch ring in the area of said yarn catch groove has a surface for increasing yarn friction at said yarn catch ring.

5. A twisting spindle according to claim 1, wherein said support bottom has an underside having an annular groove and wherein said yarn catch ring projects into said annular groove.

6. A twisting spindle according to claim 1, wherein said rotor disk and said yarn catch ring form a unitary part.

7. A twisting spindle according to claim 1, wherein:

said rotor disk has an upper side with a receiving opening;

said yarn catch ring is inserted into said receiving opening; and said yarn catch ring consists of a material increasing yarn friction at said yarn catch ring.

8. A twisting spindle according to claim 1, wherein said yarn catch ring is comprised of pins or ring segments inserted into the upper side of said rotor disk.

9. A twisting spindle according to claim 1, wherein said yarn catch ring is comprised of an annular member and pins or ring segments attached to said annular member.

10. A twisting spindle according to claim 1, wherein said protective pot has a bottom edge positioned axially above said outlet of said deflection channel.

* * * * *